United States Patent [19]

Kritzler et al.

[11] 4,114,680

[45] Sep. 19, 1978

[54] REGENERATIVE AIR PREHEATER FOR SEPARATE PREHEATING OF TWO OR MORE AIR-OR GAS STREAMS

[75] Inventors: Gerhard Kritzler, Freudenberg; Paul Eckert, Wenden, both of Fed. Rep. of Germany

[73] Assignee: Apparatebau Rothemuhle Brandt & Kritzler, Fed. Rep. of Germany

[21] Appl. No.: 790,241

[22] Filed: Apr. 25, 1977

[51] Int. Cl.[2] ..... F28D 17/00

[52] U.S. Cl. ..... 165/4; 165/7; 165/9

[58] Field of Search ..... 165/4, 7, 9

[56] References Cited

U.S. PATENT DOCUMENTS

| | | | |
|---|---|---|---|
| 1,858,508 | 5/1932 | Kignell et al. | 165/4 X |
| 3,203,471 | 8/1965 | Koch | 165/4 |
| 3,799,242 | 3/1974 | Harris et al. | 165/7 |
| 4,000,774 | 1/1977 | Puritz et al. | 165/4 |

FOREIGN PATENT DOCUMENTS

| | | | |
|---|---|---|---|
| 2,418,902 | 10/1975 | Fed. Rep. of Germany | 165/7 |
| 1,242,788 | 6/1967 | Fed. Rep. of Germany. | |
| 2,523,841 | 2/1976 | Fed. Rep. of Germany. | |

*Primary Examiner*—Albert W. Davis, Jr.
*Attorney, Agent, or Firm*—Watson, Leavenworth, Kelton & Taggart

[57] ABSTRACT

A stationary-mass rotary regenerative air preheater uses a single regenerative mass for the separately controllable heating of different streams of air. This is achieved by providing at each axial end face of the mass rotating cowls divided into rotationally symmetrical hoods each of which is sub-divided into sector-shaped compartments which have the same radial extent as the mass. A given compartment of one hood on one end face is angularly of the same extent as the corresponding compartment of the other hood on that end face. The compartments are brought to coaxial connecting ducts at the neck of each cowl. Separation of media flows even under temperature or pressure differences is assured by sealing strips at each of the radially extending walls of each hood; these are automatically operated, and those on internal (sub-dividing) walls may be operatively linked to those on external walls.

10 Claims, 6 Drawing Figures

REGENERATIVE AIR PREHEATER FOR SEPARATE PREHEATING OF TWO OR MORE AIR-OR GAS STREAMS

FIELD OF THE INVENTION

This invention relates to rotary regenerative air preheaters of the type in which a regenerative heat-exchange mass is stationary and ducts for conveying at least one of the heat exchange media rotate to sweep over axial end faces of the mass.

BACKGROUND OF THE INVENTION

In the context in which rotary regenerative air preheaters are used it is frequently desirable to obtain air streams, which have been heated by regenerative heat exchange from exhaust gases, at different temperatures or under different pressure conditions. This occurs for example where it is desired to heat separately primary and secondary air for coal fired furnace installations. The quantity and the pressure of the primary and the secondary air have to be regulatable independently of each other, the temperature of the primary air, for example, being varied in dependence on the moisture content of the fuel being used.

Conventionally the heating of these separate air streams has been done in two separate exchangers. A high capital cost is involved and obviously space is required for the accommodation of two preheaters, which nowadays can be of extremely large size ranging up as large as 15 meters in diameter.

Although this is the conventional solution, various attempts have been made before now to provide for the separate degree of heating of different components passing through a rotary regenerative heat exchanger.

There have been proposals for example for different media which are to be heated up during the heat exchange to be led separately to or from the regenerative mass.

For example in U.S. Pat. No. 1,858,508 (corresponding to German Pat. No. 484548) there is seen a stationary mass above and below which are stationary supply and outlet channels for three different media. One is a heating medium and the other two are media to be heated. The separation of the three is achieved by having at each end face of the mass rotating radially extending walls which effectively divide the mass at any one time into three sectoral flow compartments and by having above and below those walls respectively, plates rotating with the walls and in which are cut openings at respectively different radii so that these openings are in constant communication with the respective stationary supply or output ducts, the mouths of which are annuli of different radii.

Now this arrangement, at least as far as we are aware has never been put into practice, most probably for two main reasons. The first is that, because of the inherent needs of the exchanger with regard to the volumes of the mass being exposed to the different media, the rotating parts will have to be rotationally unsymmetrical and this will impose both a static and a dynamic load on the bearings. The dynamic load will be aggravated by any pressure differences existing between the different media (which under modern operating conditions, at least, there frequently are).

The second and perhaps more serious difference is that concerned with assuring seals between the various parts. There is an unsymmetrical temperature distribution within the regenerative mass which results in uneven deformations and stresses which will cause almost insoluble problems in regard to the sealing between the end faces of the mass and the rotating walls. This will be particularly serious (as will also be the problem of sealing between the plates and stationary annular ducts) in the very large size regenerative preheaters (up to 15 meters in diameter) which are used today. Our conclusion is that the type of approach represented by German Pat. No. 484548 with stationary ducts and stationary mass with gas flows being separated and directed by rotational radial walls and apertured plates is not and never has been a practical proposition.

A further and different approach to the problem has been seen in German Pat. No. 1242788 where to provide an air output of different temperatures, the regenerative mass was divided into two axially separated parts, with a rotating outlet duct having a sector shaped hood sweeping over the upper face of the upper part of the divided mass and a much smaller, coaxially arranged, pipe having a small sectoral shaped opening in communication with the output from the upper face of the lower part of the mass. This sectoral opening of the central pipe is not in direct contact with the lower part of the mass but merely permits part of the regeneratively heated air emitted from that part to be abstracted through the central pipe.

Therefore although there will be air outputs of different temperatures, there can be no precision of control as to their relative temperatures of their relative pressure or flow rates.

More recently, a proposal due to the assignees of the present application and seen in DTOS (German Laid open specification) No. P24 18 902 is one in which primary and secondary air streams are supplied concentrically with each other to separate annular volumes in the stationary regenerative mass by means of rotating and symmetrical double cowls. At least one of these cowls has a radially outer annular sectoral portion divided by an arcuate wall from a radially inner sectoral portion, thus to separate gas flows into two different radial components of the regenerative mass. This form of construction had proved successful in practice but there is a disadvantage in that when there is a difference between the amounts of primary and secondary air being passed to the heater, the flow gases (which are exchanging heat with radially separated portions of the mass by virtue of the division of the cowl or cowls) will leave the regenerative mass at very different temperatures. This results in uneven temperature and velocity distributions of those gases after they have left the mass, which may unfavourably effect the operation of dust removal installation which are connected in series to the preheater. Furthermore it has been found that this form of construction may need very precise design for the boiler in order that the subsequent flow of flue gas and air may efficiently work the regenerator. This cannot be achieved in all installations and so a solution has been sought which would liberate the designer from such constraints. This is seen in the present invention.

Also in the prior art is DTOS (German Laid open Specification) No. P2523841, in the name of the assignees of the present application. Here a rotatable hood has at one edge an extra, radially extending and sectoral-shaped, chamber. The hood and the chamber go to coaxial separate ducts at the throat of the hood. This extra chamber is a sluice chamber which has the function of withdrawing impure gas from sectors of the mass which in succession lie below it, so that that gas will not be brought into the air flow to contaminate it.

There is no concept here, and no structural possibility, of directing separate air flows through distinct heating paths.

Lastly is a proposal seen in U.S. Pat. No. 3,799,242 where a rotating mass regenerator is equipped with three different media-conveying stationary ducts at each end face. As that specification says, this is a version of the tri-sector arrangement known from the then prior art — compare German Pat. No. 484548, to which U.S. Pat. No. 1,858,508 corresponds and to which U.S. Pat. No. 3,799,242 is very close in its arrangement of the stationary ducting. There is however no equivalence in the present context between stationary ducting at the end face of the mass and the rotatable cowls seen in the preheater of the present invention, since, for example, reorganization of the duct work to permit rotation, the provision of an enclosing stationary duct within which the rotating hoods may work are involved. Furthermore one would get the type of unsymmetricality, distortion and sealing problems described in connection with German Pat. No. 484548 and for the same reasons, if one merely attempted to rotate the end-covers of the mass of U.S. Pat. No. 3,799,242, while keeping that mass stationary.

SUMMARY OF THE INVENTION

The present invention has for its object the improvement of a multiple-media stationary mass regenerative heat exchanger by a new design of the rotatory supply and discharge ducts. It has for object the ability to regulate within wide ranges the quantities and/or temperatures of the air and gas streams.

It also has for object the assurance that efficient sealing can be maintained, and distortions of the mass regularized, so that these air and gas streams will not become intermixed even when there are large thermal expansions within the regenerative mass or considerable differences between the pressures of the various media within the exchanger as a whole.

The invention provides a rotary regenerative preheater with a stationary regenerative heat exchange mass having respective axial end faces with which are sealingly related respective rotationally symmetrical cowls each having a plurality of hoods, each hood of each cowl being divided into at least two separate sectoral compartments by subdividing walls within the hoods extending radially over the whole effective radius of the mass, corresponding compartments (as comparing one hood with a next hood at a given axial end face of the mass) being of corresponding angular extension within the hoods. Hoods which are opposed to each other across the mass also have corresponding compartments (i.e. those which are axially aligned) of equal angular extension to each other so as to define a respective air flow path through the mass, from one to the other. The respective compartments within the hoods are brought to respective coaxial and concentric flow channels at the neck of the cowls, at which neck the respective flow channels are respectively sealingly related to concentric and coaxial flow channels within a stationary flow duct for the conveyance of the respective two or more media to or from the regenerative mass.

Preferably the radially extending outmost outline of each hood of each cowl comprise movable outer sealing frames which follow the sectoral form of each hood and extend over the whole peripheral line at which it is sealingly proximate to the axial end face of the mass, while the sealing between radial subdividing walls of the respective hoods is achieved by radial sealing strips of which the clearance (between them and the respective axial end faces) is regulated in dependence upon the movement of at least part of the outer sealing frames.

The radial sealing strips may be connected at their mutually adjacent ends by a pivotal connection to each other and be automatically adjustable at that position relative to the outer walls of the hood, and be operatively linked to sealing strips sealing the radial subdividing walls to the axial end face of the mass, so that they are similarly adjustable.

Further, because the media are to be controllably heated or cooled within wide temperature ranges, and at least when the regenerative mass has large dimensions correspondingly large distortion curvatures of the axial end faces of the mass are produced under different working conditions, in an alternative we may automatically control the setting of the sealing frame in relation to that end face in dependence upon temperature in order to obtain the best sealing results. This and the automatic adjustment of the radial strips can be achieved by means of self-adjusting devices as seen for example in U.K. Patent Specification No. 1412872 or U.S. Pat. No. 4,000,774.

DESCRIPTION OF A PREFERRED EMBODIMENT

Figure 1:
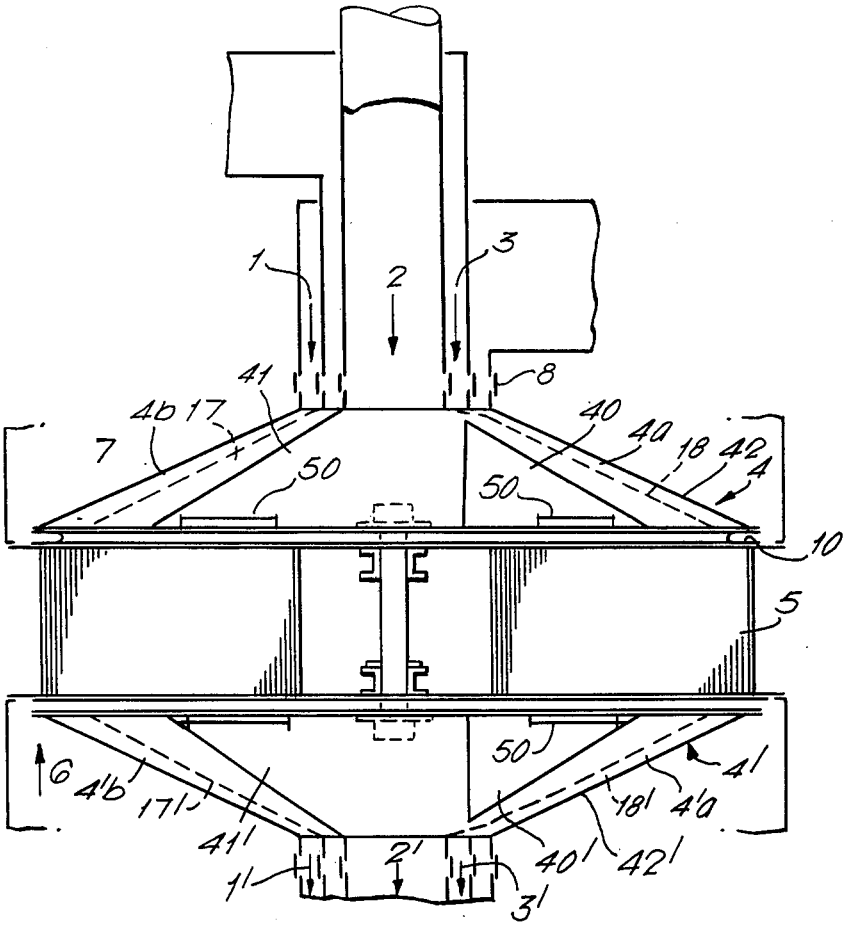
FIG. 1 is a side view on the arrow I, FIG. 2 of an embodiment of regenerative air preheater.

As seen in FIG. 1 coaxial cylindrical stationary ducts 1,2 and 3 connect coaxially with a rotationally symmetrical and radially compartmented cowl 4 made up of two symmetrical and diametrically opposed hoods **4*a*, 4*b*. The cowl 4 is driven by conventional means to rotate in the direction of the arrow A, FIG. 2, over an upper axial end face of a stationary regenerative mass 5 which is divided into sector-shaped compartments 5'. At the lower axial end face of the mass 5 is a corresponding cowl 4' leading in turn to coaxially arranged stationary ducting 1',2',3' corresponding to ducting 1,2 and 3. Cowls 4,4' cover only a portion (approximately half) of the area of each axial end face, to allow the counterflow through that mass of heating gases which are confined by walls of stationary ducts 6 and 7. The direction of air flow downwardly as indicated by the arrows in ducts 1,2,3 and the direction of heating gas flow is upwardly as indicated by the arrow in the duct 6. Sealing engagement between the stationary ducts 1,2,3 and the rotating cowls 4,4' are achieved by conventional sliding seals indicated diagrammatically at 8, FIG. 1. Each hood of each cowl 4,4', is provided with a sealing frame 10,10'** which extends all the way round its generally sectoral periphery to ensure a gas seal with the axial end faces over which the respective cowls rotate, this sealing frame being borne in a manner known per se on spring loaded pins so that the frame may accommodate to the distortions which occur in the regenerative mass when temperature differences are set up between its ends.

Figure 5:
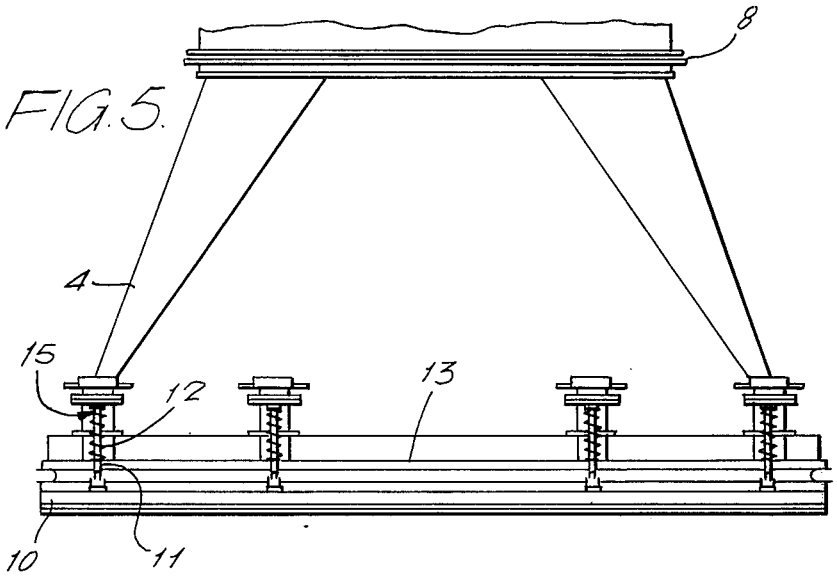
FIG. 5 is a side view of a hood of the upper cowl and FIG. 6 is a side view of a device for adjusting radial sealing strips.
Figure 6:
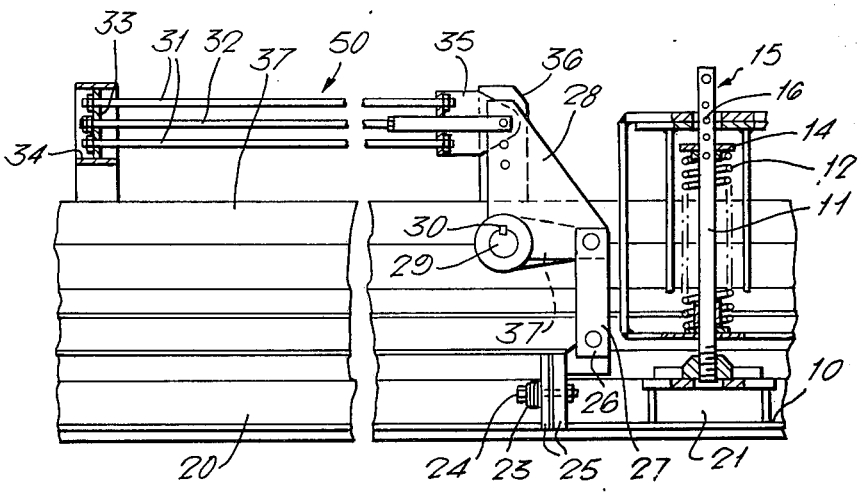

The spring pins which support the sealing frames 10 around the arcuate outer faces of the cowl 4,4' are seen best in FIGS. 5 and 6. Assemblies 15 consist of pins 11 linked to the frame 10 at their base by being screwed into nuts in saddles on the frame. The weight of the frame is taken at least partially by springs 12 surrounding the pins which bear at their lower end on a flange 13 of the hood and at their upper end against a reaction surface offered by washer 14 (see FIG. 6) the position of which along the pin 11 is governed by a transverse stop pin 16. A plurality of apertures are provided for in the pin 11, which of these is selected is a coarse setting, and the amount the pin is screwed unto the nut on the frame a fine setting governing the spring pressure which will be exerted by the spring 12. This is set during assembly to provide an appropriate range of adjustment in the sealing frame.

Figure 3:
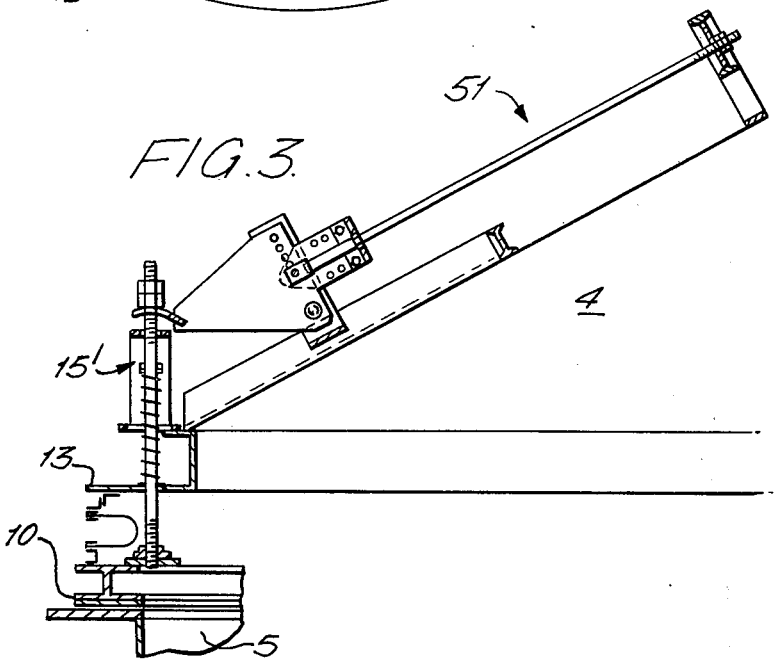
FIGS. 3 and 4 show respectively side elevation and plan views of an automatic stop adjusting device for spring-loaded bearing pins of the sealing frames.
Figure 4:
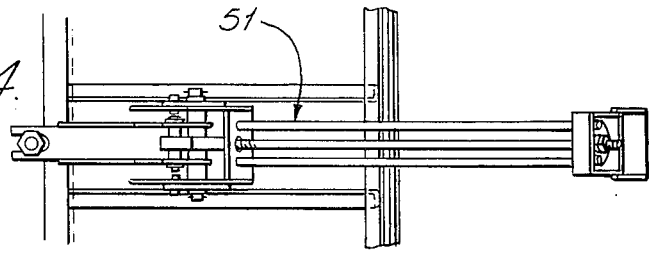

In an alternative, the setting of the stops of these pins in modified assemblies 15' is automatically adjusted by an automatic stop adjusting device such as that shown in side view and plan view respectively in FIGS. 3 and 4. This automatic stop adjusting device 51 for the bearing spring pins of the sealing frame 10, is disclosed for example in U.K. Patent Specification No. 1412872 and corresponding U.S. Pat. No. 4,000,774, the contents of which are hereby incorporated by reference.

Figure 2:
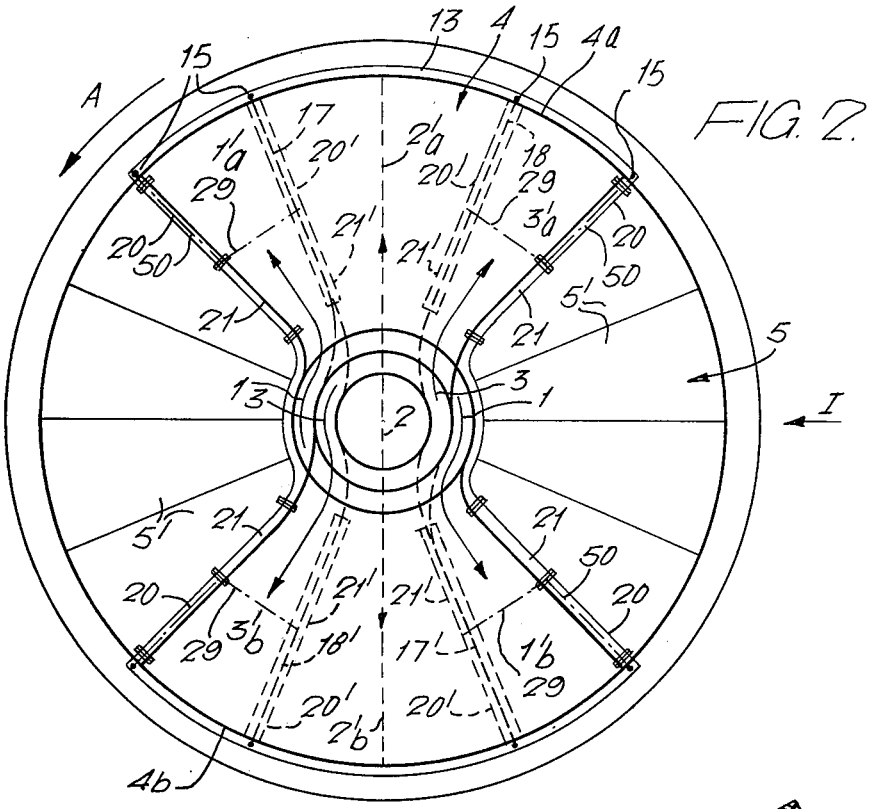
FIG. 2 shows a plan view looking from immediately above the upper rotating cowl of the exchanger.

FIG. 2 shows how each cowl 4 is divided into two equal and symmetrical hoods **4*a* and 4*b* at the upper end face and 4'*a* and 4'*b* opposing them at the lower end face. The outermost edge of each cowl is provided with a sealing frame 10. The adjustment of this frame along the arcuate outer edge of each hood is as has been described but along the radially extending outer walls of each hood the frame is formed of radial sealing strips 20,21**, the setting of which is automatically adjustable.

Each hood has a conical roof 42 or 42' and radially extending bounding side walls 40,41 or 40',41'. As is also clearly seen from FIG. 2 each hood is divided up into sectoral compartments by radially extending sub-dividing walls 17,17' and 18,18'. Below each sub-dividing wall are provided radially extending sealing strips 20',21'.

The setting of each of the strips 20,21,20',21' is such as to follow distortions arising in the mass. At least at the hot end of the mass this is preferably determined automatically in dependence upon the gas temperature at that end of the regenerative mass. The arrangement of the strips is as follows.

The radially outer strip 20,20' is linked to the radially inner strip 21,21', by a pivotal connection. This is achieved by securing together vertically extending end flanges 22,25 of the respective plates by a loose nut and bolt connection 24, a compressible spring or washer 23 being interposed between the head of the bolt and a flange 25. If the flanges are bodily lifted they will lift respectively the ends of the strips 20,21 to which they are connected with a slight alteration in the angular relationship of the flanges 25 which is permitted by yielding of the spring 23. This lifting is automatically achieved in response to the temperature of the media at that end face of the mass, by a control device 50 analogous stop-adjusting device 51 but which (because it is to be used on radially extending seal strips which must not be allowed to interfere with radially-extending divider wall edges of the mass) is connected with the strips so as positively to drive them towards or away from the mass. A connection flange 26 is attached to one of the flanges 25 which through a pivoted link 27 can be lifted or lowered by the rotation of a bell crank 28 about an axis defined by axles 29 to which the bell crank is keyed by key 30.

The bell crank 28 is also connected to an automatic temperature responsive control device comprising parallel rods 31,32 the rods 31 and 32 being respectively of different coefficients of thermal expansion. At their end remote from the bell crank the rods are all secured to a movable transmission plate 33 which is guided within a slideway 34. Rods 31 are anchored at their ends nearer the bell crank to a static trunnion plate 35 secured to a bracket 36 mounted on the frame 37 of the cowl. It can be seen that the effect of changes in temperature is, because of differential expansion or contraction of the rods 31,32, to cause an appropriate change in the position of that end of rod 32 which is secured to the bell crank 28; thereby altering the angle at which that crank is positioned and in consequence altering the relative height of the flanges 25 which are fixed to the radial strips 30,21.

To assure a corresponding adjustment of the strips 20',21' which are on the radial dividing walls 17,18 within the hoods, the axle 29 is extended as indicated in FIG. 2 as far as those radial dividing walls 17,18 where a lever arm (the nature of which is indicated in dotted lines 37 in FIG. 6) is attached to it and operates a lever linkage comprising the arms 27 and flanges 25,26 exactly as described with respect to sealing strips 20,21. This assures automatic adjustment of the position of the radial extending sealing strips 20,21,20',21' at a position approximately half-way between the innermost and outermost portions of the regenerative mass i.e. at a position where the calotte shaped distortion of the mass which occurs upon temperature gradients being set up between its ends will be at its greatest.

The compartments into which the walls 17,18,17',18' divide the hoods which make up each cowl are for the reception respectively of the air streams from the coaxial ducts 1,2 and 3 or for receiving respectively air streams from the regenerative mass to the coaxial ducts 1',2',3'. The disposition of defining walls which link the ducts to the dividing and boundary walls is seen best in FIG. 2 which shows how the compartments **1'*a*, and 1'*b* defined respectively by sub-dividing walls 17,17' receive the air flow from duct 1 while ducts 3'*a* and 3'*b* defined by the sub-dividing wall 18,18' receive the flow from ducts 3. Flow from duct 2 is received in the compartments 2'*a* and 2'*b***.

There is an exactly corresponding arrangement for the hoods at the lower end of the mass, so that compartments of respective hoods which are axially opposed across the mass define separate air paths through the mass, each air path being of the radial extent of the mass and with an air flow parallel to the axis of the mass.

In short, the arrangement at one end of the mass is a mirror image of that at the other, about a plane normal to the axis of the mass.

Although as shown the angular extension of ducts **1'*a* is equal to that of 3'*a* and that of 1'*b* to 3'*b*, these ducts need not be angularly equal to each other. The only requirement at each axial end face of the mass is that corresponding ducts (e.g. ducts 1'*a* and 1'*b* on the one hand and 3'*a* and 3'*b* on the other) shall have the same cross section and angular extension so that flow symmetry in respect of each of the ducts 1,2,3** is assured.

It can be seen that the construction shown in this embodiment permits the air streams to be heated separately from each other, being conducted to and from the regenerative mass by compartments of hoods of rotationally symmetrical cowls which compartments extend over the whole effective radius of the regenerative mass and which corresponds to each other at the respective end faces of the mass.

Because each compartment is held separate from each other and is provided with controlled sealing means it is possible to chose freely the quantities or pressures of the various media to be treated.

It is of course possible by the provision of by-pass ducting outside the regenerator to achieve a greater range of operational effects. This versatility is particularly marked with the embodiment which has been described where each hood is divided into three compartments, but the invention is equally applicable to embodiments in which the hoods are divided into two compartments or into four or more by the provision of an appropriate number of radially extending sub-dividing walls.

We claim:

1. Rotary regenerative air preheater having (a) a stationary regenerative heat-exchange mass having a central axis (b) axial end faces of said mass (c) first stationary ducting for conducting exhaust gas to and from said mass (d) second stationary ducting for conducting air to and from said mass and comprising a plurality of separate ducts beyond each end face of the mass and within the first stationary ducting (e) the said plurality of separate ducts comprising concentrically arranged ducts disposed coaxially with the mass (f) a cowl at each axial end face of the mass for conducting air to or from the respective end face and the concentrically arranged ducts (g) each cowl being rotatable to sweep the respective end face of the mass, in synchronism with the other cowl (h) each cowl comprising a plurality of hoods, the cowl being rotationally symmetrically arranged with respect to the axis of the mass and each hood comprising radially extending and arcuately extending bounding walls (j) each hood being sub-divided internally by dividing means including at least one radially extending dividing wall whereby each hood is sub-divided into a plurality of compartments having the same radial extent as the mass (k) corresponding compartments of the hoods at each axial end face of the mass being of corresponding angular extent and being at all times opposed to said corresponding compartments across the mass whereby to form a plurality of distinct air paths through the mass between the said compartments (l) the dividing means including means for conducting flow of air to or from a given one only of the plurality of concentrically arranged ducts to or from given corresponding compartments only of the hoods at both axial end faces of the mass.

2. Rotary regenerative air preheater as claimed in claim 1 additionally comprising (m) a sealing frame for each hood and extending around the outer periphery of that hood adjacent the axial end face of the mass (n) sealing strips along each radial wall of each hood adjacent the axial end face of the mass (o) spring loaded mounting means for at least part of said frame on each hood (p) yieldable, gas-tight connection means between the sealing frame and sealing strips and the hood and (q) means for adjusting the setting of said frame and strips relative to the hood.

3. Rotary regenerative air preheater as claimed in claim 2 wherein the sealing strips on the radial walls include a first radially inner strip and a second radially outer strip and there is (s) an articulated connection between the radially outer end of the radially inner strips and the radially inner end of the radially outer strips and (t) at each hood at at least one axial end face of the mass, an automatically operable adjustment device operatively linked to the articulated connection the device including (i) a plurality of bars comprising sets of bars, the bars being in sets, respective sets being of a material of one coefficient of thermal expansion and the coefficients of the materials of the sets being different, the sets being arranged in parallel to each other (ii) a reference abutment for positioning one end of one said set of bars (iii) a lever at one end of an other said set of bars and (iv) a strap connecting said lever to said articulated connection, such that expansion and contraction of said sets of bars drives said articulated connection axially in relation to the regenerative mass.

4. Rotary regenerative air preheater as claimed in claim 3 having additionally (r) means for interlinking sealing strips on said at least one dividing wall and said radial bounding walls whereby adjustment to the setting of the sealing strips on said radial bounding walls is transmitted to the sealing strips on said at least one dividing wall.

5. Rotary regenerative air preheater as claimed in claim 4 wherein the device further includes (v) a shaft pivotally mounting said lever (vi) means constraining said shaft to rotate with said lever (vii) a lever arm on said shaft at a position adjacent a radial dividing wall (viii) means constraining said lever to rotate with said shaft and (ix) a strap connecting said lever arm to said articulated connection of the radial sealing strip of the radial dividing wall.

6. Rotary regenerative air preheater according to claim 1 wherein there is two said dividing walls in each hood whereby each hood is divided into three said compartments.

7. Rotary regenerative air preheater having (a) a stationary regenerative heat-exchange mass having a central axis (b) axial end faces of said mass (c) first stationary ducting for conducting exhaust gas to and from said mass (d) second stationary ducting for conducting air to and from said mass and comprising a plurality of separate ducts beyond each end face of the mass and within the first stationary ducting (e) the said plurality of separate ducts comprising concentrically arranged ducts disposed coaxially with the mass (f) a plurality of hoods at each axial end face of the mass, respective ones of said hoods being opposed to each other axially through the mass (g) the angular extent of each hood being the same and being defined by two radial bounding walls extending the whole radial extent of the mass (h) at least one subdividing wall in each hood extending radially of the mass and to the whole radial extent of the mass whereby to subdivide the hood into at least two compartments each extending the whole radial extent of the mass (i) the said hoods being balanced at each axial end of the mass across the said axis (j) means for rotating said hoods in a given direction of rotation whereby a first said radial bounding wall is a leading wall and a second said radial bounding wall is a trailing wall (k) the angle subtended at the axis between said leading wall and the next adjacent subdividing wall being the same in each hood on each axial end face of the mass (l) the angle subtended at the axis between said trailing wall and the next adjacent subdividing wall being the same in each hood on each axial end face of the mass.

8. Rotary regenerative air preheater as claimed in claim 7 additionally comprising (m) a sealing frame for each hood and extending around the outer periphery of that hood adjacent the axial end face of the mass (n) sealing strips along each radial wall of each hood adjacent the axial end face of the mass (o) spring loaded mounting means for at least part of said frame on each hood (p) yieldable, gas-tight connection means between the sealing frame and sealing strips and the hood and (q) means for adjusting the setting of said frame and strips relative to the hood.

9. Rotary regenerative air preheater as claimed in claim 8 having additionally (r) means for interlinking sealing strips on said at least one dividing wall and said radial bounding walls whereby adjustment to the setting of the sealing strips on said radial bounding walls is transmitted to the sealing strips on said at least one dividing wall.

10. Rotary regenerative air preheater as claimed in claim 9 wherein the sealing strips on the radial walls include a first radially inner strip and a second radially outer strip and there is (s) an articulated connection between the radially outer end of the radially inner strips and the radially inner end of the radially outer strips and (t) at each hood at at least one axial end face of the mass, an automatically operable adjustment device operatively linked to the articulated connection the device including (i) a plurality of bars, the bars being in sets, respective sets being of a material of one coefficient of thermal expansion and the coefficients of the materials of the sets being different, the sets being arranged in parallel to each other (ii) a reference abutment for positioning one end of one said set of bars (iii) a lever at one end of an other said set of bars (iv) a strap connecting said lever to said articulated connection, such that expansion and contraction of said sets of bars drives said articulated connection axially in relation to the regenerative mass (v) a shaft pivotally mounting said lever (vi) means constraining said shaft to rotate with said lever (vii) a lever arm on said shaft at a position adjacent a radial dividing wall (viii) means constraining said lever to rotate with said shaft and (ix) a strap connecting said lever arm to said articulated connection of the radial sealing strip of the radial dividing wall.

* * * * *